US009045817B2

(12) United States Patent
Toki et al.

(10) Patent No.: US 9,045,817 B2
(45) **Date of Patent: *Jun. 2, 2015**

(54) HEAT TREATED GALVANNEALED STEEL MATERIAL AND A METHOD FOR ITS MANUFACTURE

(75) Inventors: Tamotsu Toki, Nishinomiya (JP); Atsushi Tomizawa, Minou (JP); Nobusato Kojima, Amagasaki (JP); Kazuya Ishii, Nishinomiya (JP); Kazuhito Imai, Amagasaki (JP); Toyomitsu Nakamura, Amagasaki (JP); Naoaki Shimada, Osaka (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 819 days.

This patent is subject to a terminal disclaimer.

(21) Appl. No.: 12/842,336

(22) Filed: Jul. 23, 2010

(65) Prior Publication Data

US 2011/0048585 A1 Mar. 3, 2011

Related U.S. Application Data

(63) Continuation of application No. PCT/JP2009/051165, filed on Jan. 26, 2009.

(30) Foreign Application Priority Data

Jan. 28, 2008 (JP) ..... 2008-016531

(51) Int. Cl.
*C23C 2/06* (2006.01)
*C23C 2/28* (2006.01)
(Continued)

(52) U.S. Cl.
CPC ... *C23C 2/06* (2013.01); *C21D 1/18* (2013.01); *C21D 1/19* (2013.01); *C21D 9/52* (2013.01); *C23C 2/28* (2013.01); *C21D 2221/00* (2013.01)

(58) Field of Classification Search
CPC ..... B22F 2207/05
USPC ..... 148/320–337, 240–287, 516–537; 427/318–321, 431–433; 428/655–659
See application file for complete search history.

(56) References Cited

U.S. PATENT DOCUMENTS 5,049,453 A * 9/1991 Suemitsu et al. ..... 428/629
5,256,219 A * 10/1993 von Hagen et al. ..... 428/659
(Continued)

FOREIGN PATENT DOCUMENTS

EP 1 439 240 7/2004
JP 10-140317 * 5/1998 ..... C23C 2/28
(Continued)

*Primary Examiner* — Roy King
*Assistant Examiner* — Vanessa Luk
(74) *Attorney, Agent, or Firm* — Clark & Brody

(57) ABSTRACT

A heat treated galvannealed steel material having excellent post-painting corrosion resistance and a high strength which is suitable for use as an automotive part and a method for its manufacture are provided. A galvannealed steel material having a galvannealed coating on at least one side thereof is heat treated by heating at least a portion thereof to a temperature range in which hardening is possible. The coating remaining on the surface of at least a part of the portion which underwent heat treatment has a coating weight of at least 20 g/m$^2$ and at most 80 g/m$^2$ per side and an Fe content of at least 15% and at most 35%, an η phase is present in the coating, and the centerline average roughness Ra of the surface of the coating is at most 1.5 μm.

16 Claims, 1 Drawing Sheet

(51) Int. Cl.

| | |
|---|---|
| ***C21D 1/18*** | (2006.01) |
| ***C21D 1/19*** | (2006.01) |
| ***C21D 9/52*** | (2006.01) |

(56) References Cited

U.S. PATENT DOCUMENTS

| | | | | |
|---|---|---|---|---|
| 6,159,622 | A * | 12/2000 | Hori et al. | 428/659 |
| 6,368,728 | B1 * | 4/2002 | Tobiyama et al. | 428/659 |
| 8,490,457 | B2 * | 7/2013 | Nakamura et al. | 72/369 |
| 2001/0008654 | A1 * | 7/2001 | Ferrero et al. | 427/433 |
| 2004/0166360 | A1 * | 8/2004 | Imai et al. | 428/658 |
| 2005/0139291 | A1 * | 6/2005 | Taira et al. | 148/277 |
| 2008/0075970 | A1 | 3/2008 | Suzuki et al. | |
| 2013/0280548 | A1 * | 10/2013 | Nakamura et al. | 428/586 |

FOREIGN PATENT DOCUMENTS

| | | |
|---|---|---|
| JP | 2000-248338 | 9/2000 |
| JP | 2000-328221 | 11/2000 |
| JP | 2002-317257 | 10/2002 |
| JP | 2004-323974 | 11/2004 |
| WO | 2006/093006 | 9/2006 |

* cited by examiner

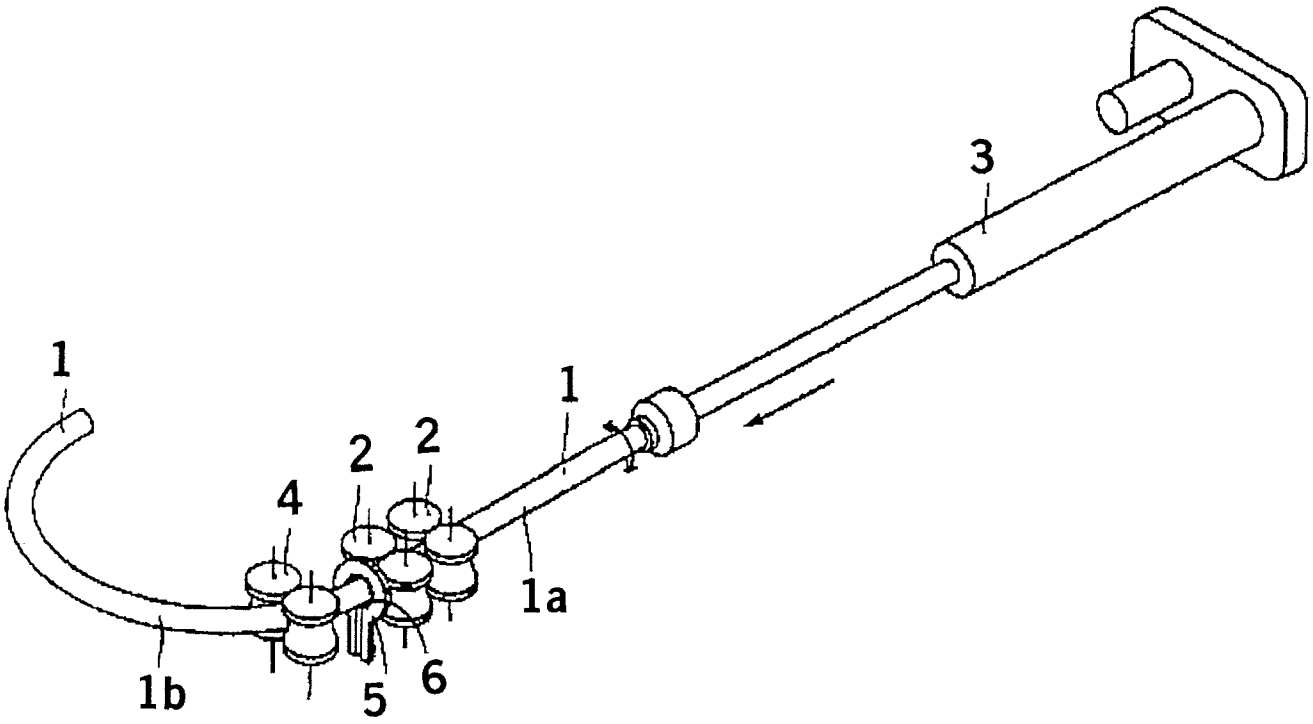
3
1
1a
2
2
6
5
4
1b
1

HEAT TREATED GALVANNEALED STEEL MATERIAL AND A METHOD FOR ITS MANUFACTURE

This application is a continuation of International Patent Application No. PCT/JP2009/051165, filed Jan. 26, 2009. This PCT application was not in English as published under PCT Article 21(2).

TECHNICAL FIELD

This invention relates to a heat treated galvannealed (galvanized/annealed) steel material formed by heat treatment of a galvannealed steel material and a method for its manufacture. More particularly, it relates to a heat treated galvannealed steel material which has a high strength and excellent post-painting corrosion resistance (corrosion resistance after paint coating) and which is suitable for use in automotive parts, for example. It also relates to a method for its manufacture.

BACKGROUND ART

Zinc-based coated steel materials such as hot dip galvanized steel sheet, galvannealed steel sheet, and electrogalvanized steel sheet are widely used in automotive parts and particularly automotive parts constituting automobile bodies since these materials have just sufficient corrosion resistance in the environment of use of the automobile parts and are advantageous from the standpoint of cost. Among these materials, galvannealed steel sheet is manufactured by continuously subjecting steel sheet to hot dip galvanizing and then to heat treatment at a temperature of around 500-550° C. to cause mutual diffusion between the zinc layer and the steel substrate (base metal) so as to convert the entire coating layer into an Fe—Zn intermetallic compound layer. Compared to hot dip galvanized steel sheet or electrogalvanized steel sheet, galvannealed steel sheet has a coating layer which is electrochemically somewhat nobler, and its sacrificial anticorrosive ability is somewhat lower. However, the coating layer of a galvannealed steel sheet has improved adhesion to a paint coating which is formed thereon. For this reason, galvannealed steel sheet is widely used for automotive parts which are normally painted by electro-deposition coating following chemical conversion treatment. The coating layer of a galvannealed steel sheet is formed from Fe—Zn intermetallic compounds which are generally hard and brittle. Therefore, when such a sheet is subjected to press working accompanied by bending or drawing, a portion of the coating layer may cause powdering. In such cases, hot dip galvanized steel sheet or electrogalvanized steel sheet is used instead.

In recent years, there has been an increasing demand that automobile bodies guarantee safety during collisions. In order to cope with this demand, efforts to increase the energy absorbing properties of automotive parts at the time of a collision are being progressed. For example, efforts are being made to increase the energy absorbing ability at the time of a side impact by reinforcing a door with a side impact beam formed from a metal pipe such as a steel pipe by imparting a suitable curved shape over generally the entire length of the pipe, or by optimizing the shape or curvature of a reinforcing member which is installed inside a center pillar. For these purposes, processing techniques are being developed for bending members of a metal pipe and particularly steel pipe or pre-formed members of steel sheets into a shape suitable for automobile parts.

There is a strong demand for automobile parts to be lightweight and high strength in order to decrease the weight of automobile bodies so as to prevent global warming. In response to this demand, a high tensile strength steel having a strength level totally different from in the past such as a tensile strength of at least 780 MPa or 900 MPa or above is now being used. It is difficult to perform bending or similar working in a cold state on members formed from high tensile strength steel. Even when bending or similar working is carried out in a hot state, variations in shape due to nonuniform strains unavoidably develop, and there is a problem with respect to shape retention. In addition, in order to perform bending to an optimal shape, there is a demand for the development of bending techniques which can bend a steel material with high precision so as to form a bent shape which widely varies such as a shape in which the bending direction varies 2-dimensionally or 3-dimensionally.

In PCT/JP2006/303220, the present inventors proposed a hot bending method and apparatus which, as described below, can simultaneously and efficiently carry out bending and quenching of a material being worked using a roller die which can move multi-dimensionally even when carrying out continuous bending in which the bending direction of a steel material varies 3-dimensionally.

In this bending method, the steel material being worked is sequentially heated by a high-frequency induction heating coil to a temperature at which plastic working of the material being worked can easily be performed, or optionally to at least a temperature at which quenching of the material being worked is possible and at which the metal structure does not coarsen. The locally heated region is plastically deformed using a movable roller die and then immediately rapidly cooled. When carrying out this bending method, it is practical from the standpoint of manufacturing costs to use equipment which heats the material being worked in air.

As stated above, a steel material used in an automotive part is generally subjected to chemical conversion treatment and electro-deposition coating, and zinc-based coated steel materials are widely used in this application in order to increase corrosion resistance. Therefore, if zinc-based coated steel materials can be used in the bending method proposed in the above PCT application, a bent member or a hardened member having corrosion resistance can be manufactured while preventing oxidation of the steel base metal, and application of such coated steel materials to automotive parts can be strongly promoted.

However, heating of a zinc-based coated steel material to a high temperature at which quenching is possible (such as the $A_3$ transformation point or higher) causes the following problems: (a) there is the possibility of zinc vaporizing during the heating process due to the fact that the vapor pressure of zinc, which is, for example, 200 mm Hg at 788° C. and 400 mm Hg at 844° C., rapidly increases as the temperature increases, (b) oxidation of zinc may occur during heating in air, and (c) there is the possibility of the coating layer disappearing due to the phenomenon that Zn dissolves in the ferrite phase of the base metal to form a solid solution, this phenomenon becoming significant when a zinc-based coated steel is heated to at least 600° C. and particularly to above 660° C. at which the Γ phase ($Fe_3Zn_{10}$) decomposes. These problems may cause the coating layer to be unable to perform its function.

Patent Document 1 identified below discloses a method of manufacturing a strengthened steel material by subjecting a steel sheet for induction hardening which has been galvanized to induction hardening which is carried out by heating and subsequent cooling such that the heating temperature is at least the $Ar_3$ point and at most 1000° C. and that the heat cycle time from the start of heating until cooling to 350° C. is restricted to at most 60 seconds. According to this method, a hot dip galvanized steel sheet in which the base sheet is a steel sheet for quench hardening can be used to manufacture a strengthened member by induction hardening such that regions to be strengthened are hardened by induction hardening while the coating on the hardened regions remains. By limiting the Fe content of the coating layer to at most 35% (in this description, unless otherwise specified, percent means mass percent), an automotive part having excellent paint coatability and corrosion resistance can be provided.

Patent Document 1: JP 2000-248338 A

DISCLOSURE OF INVENTION

Problem which the Invention is to Solve

In order to elucidate the behavior of the zinc coating layer formed on the steel sheet for hardening proposed in Patent Document 1, the present inventors carried out experiments in which a galvannealed steel material was subjected to heat treatment by high-frequency induction heating followed by cooling.

When a galvannealed steel material having a coating weight of 60 g/m$^2$ per side, which is a usual coating weight, is heated to around 900° C. and then rapidly cooled, the remaining coating has a composition containing at least 15% of Fe, and an η phase (chemical formula: Zn) is present in the coating.

This result is thought to be produced by the following mechanism. In the case of a galvannealed steel material, during the process of high-frequency induction heating and subsequent cooling, the intermetallic compounds in the coating layer are temporarily decomposed and then reconstituted. Namely, the heating temperature of 900° C. is higher than the melting or decomposition temperature of the ζ phase (chemical formula: $FeZn_{13}$), the δ1 phase ($FeZn_7$), the Γ1 phase ($Fe_5Zn_{21}$), and the Γ phase ($Fe_3Zn_{10}$) which are all Fe—Zn intermetallic compounds. Therefore, in the heating process, only a liquid phase of Zn containing a high concentration of Fe remains in the coating, and in the cooling process, solidification takes place in which liquid phase Zn partially remains while intermetallic compounds precipitate.

The remaining coating formed after this heating and cooling process has an extremely coarse surface roughness. A heat treated zinc-based coated steel material in which the surface condition of its remaining coating is deteriorated by heating and cooling in this manner has an extremely poor degreasing ability when rust preventing oil which is applied for temporary rust prevention is removed, and as a result, its corrosion resistance after paint coating which is performed after degreasing by chemical conversion treatment and electrodeposition coating is markedly worsened.

Thus, a zinc-based coated steel material cannot exhibit the level of post-painting corrosion resistance which is demanded of an automotive part if it is heated to a high temperature region of at least the $Ar_3$ point and then cooled since the surface roughness of the coating which remains after cooling becomes coarse.

The present invention was made in light of such problems of the prior art, and its object is to provide a heat treated galvannealed steel material which has excellent post-painting corrosion resistance and a high strength suitable for use as an automotive part, for example, and a method for its manufacture.

Means for Solving the Problem

The present inventors found that in order to solve the above-described problem, when carrying out cooling of a galvannealed steel material which has been heated to a high temperature, if heating is carried out after reducing the surface roughness Ra of the coating layer of the galvannealed steel material before heating so that a uniform Fe—Zn reaction progresses during the heating process, an η phase (Zn) in which Fe is dissolved in a supersaturated concentration is present in the coating remaining on the surface of the steel material after cooling.

Surface irregularities in the coating of a galvannealed steel material are originally caused by nonuniform reactions between Fe and Zn, and these surface irregularities are further promoted by subsequent heating. In order to prevent this problem, the surface roughness of a coating remaining after cooling can be greatly decreased by previously setting the surface roughness Ra of a coating layer of a galvannealed steel material before heating to a low value. An η phase (Zn) present in a coating layer solidifies in depressions in the remaining coating, as a result of which the surface roughness after cooling can be further decreased and the surface condition can be improved.

Namely, the present invention is based on the knowledge that when a galvannealed steel material is heated to a high temperature range of at least the $Ar_3$ point and then cooled, the surface properties (the centerline average roughness Ra) of the remaining coating can be improved and as a result, post-painting corrosion resistance and coating adhesion of the steel material required of an automotive part can be adequately achieved by setting the surface roughness of the coating layer before heating to a low value and maintaining a prescribed coating weight after cooling and by controlling the Fe content of the coating layer such that an η phase exists in the coating.

The present invention is a heat treated galvannealed steel material formed from a galvannealed steel material which is a steel material having a galvannealed coating on at least one side thereof by heat treatment in which at least a portion of the galvannealed steel material is heated to a temperature range in which quench hardening is possible, characterized in that the coating remaining on the surface of at least a part of the portion which has undergone heat treatment has a coating weight of at least 20 g/m$^2$ and at most 80 g/m$^2$ per side and an Fe content of at least 15% and at most 35%, the coating has an η phase present therein, and the centerline average roughness Ra prescribed by JIS B 0610 on the surface of the coating is at most 1.5 μm.

A heat treated galvannealed steel material and a galvannealed steel material according to the present invention are not limited to ones having a particular transverse cross-sectional shape, and they can be members having a closed cross section with a transverse cross-sectional shape such as a round shape, a rectangular shape, a trapezoidal shape, or the like; members having an open cross section which are manufactured by roll forming or the like (such as channels or angles); shaped sections having an irregular cross-sectional shape which are manufactured by extrusion (such as channels); rod-shaped members with various transverse cross-sectional shapes (round bars, square bars, shaped bars); and so-called tapered steel members which are members of the above-described types having a transverse cross-sectional area which continuously varies in the lengthwise direction.

The term "one side" used herein for a heat treated galvannealed steel material or galvannealed steel material means the inner surface or the outer surface when the material is the above-described members having a closed cross section; in the case of the above-described members having an open cross section, it means one of the surfaces of the flat components making up the open cross section; and in the case of the above-described rods, it means the outer surface.

A heat treated galvannealed steel material according to the present invention preferably contains not greater than 0.45% of Al in the coating remaining after heat treatment.

From another standpoint, the present invention is a method of manufacturing a heat treated galvannealed steel material characterized by providing a galvannealed steel material having on at least one side thereof a coating layer with a weight of at least 30 $g/m^2$ and at most 90 $g/m^2$ per side, the coating layer having an Fe content of at most 20% and a surface roughness Ra of at most 0.8 μm, heating at least a portion of the galvannealed steel material at a rate of temperature increase of at least $3.0\times10^{2\circ}$ C. per second to a temperature in a range of at least $8.0\times10^{2\circ}$ C. and at most $9.5\times10^{2\circ}$ C., keeping the temperature in that range for at most 2 seconds, and then cooling at a cooling rate of at least $1.5\times10^{2\circ}$ C. per second.

In a method of manufacturing a heat treated galvannealed steel material according to the present invention, the coating layer preferably contains not greater than 0.35% of Al.

Effects of the Invention

According to the present invention, when carrying out heat treatment of a galvannealed steel material to manufacture a heat treated galvannealed steel material having a coating remaining on its surface, by leaving a coating having a prescribed coating weight and adjusting the Fe content of the coating layer so that an η phase is present in the coating, the surface condition of the coating (the surface roughness Ra) can be improved. As a result, a heat treated galvannealed steel material having post-painting corrosion resistance and adhesion of a painted coating which can fully satisfy the level required of automotive parts which is becoming increasingly higher can be manufactured.

BRIEF EXPLANATION OF THE DRAWINGS

FIG. 1 is an explanatory view showing in simplified form a manufacturing apparatus for an embodiment of a heat treated galvannealed steel material.

1 material to be worked
1*a* zinc-based coated steel
1*b* heat treated zinc-based coated steel
2 support means, support rolls
3 feed device
4 movable roller die
5 high-frequency induction heating coil
6 cooling device

EMBODIMENTS OF THE INVENTION

Below, best modes of a heat treated galvannealed steel material and a method for its manufacture according to the present invention will be explained in detail while referring to the attached drawings.

This embodiment of a heat treated galvannealed steel material is a galvannealed steel material which has undergone galvannealing on at least one side thereof and at least a portion of which has then undergone heat treatment by heating to a temperature at which quench hardening is possible. The weight of a coating remaining on the surface of at least a part of the portion which underwent heat treatment is at least 20 $g/m^2$ and at most 80 $g/m^2$ per side, the Fe content of the coating is at least 15% and at most 35%, an η phase is present in the coating, and the centerline average roughness Ra prescribed by JIS B 0610 of the surface of the coating is at most 1.5 μm.

In this embodiment, the galvannealed steel material is not limited to one having a specific transverse cross-sectional shape. For example, it can be a member with a closed cross section having a transverse cross-sectional shape which is round, rectangular, trapezoidal, or the like, a member with an open transverse cross section which is manufactured by roll forming or the like (such as a channel or an angle), a shaped member with an irregular cross section which is manufactured by extrusion (such as a channel), a rod having various transverse cross-sectional shapes (a round rod, a square rod, an irregular rod), and a so-called tapered steel having one of the above shapes which continuously varies in transverse cross-sectional area in the lengthwise direction.

As described above, in a manufacturing method of this embodiment, the surface roughness Ra of the galvannealed steel material prior to heat treatment is at most 0.8 μm. This surface roughness can be imparted when the starting material of a galvannealed steel material is in the form of a flat plate, or it can be imparted at the time of roll forming. Therefore, among the above-described closed cross section materials, open cross section materials, irregular cross section materials, and rods, a steel material having continuity in the lengthwise direction such as a steel pipe including a rectangular pipe is preferred.

A galvannealed steel material in this embodiment is formed by subjecting a steel material as a base metal steel to hot dip galvanizing and then to annealing for alloying to obtain a galvannealed steel material. An electrogalvanized steel may be annealed to obtain a galvannealed steel material.

The base metal steel for the galvannealed steel material of this embodiment may be a high strength steel which can be subjected to hot bending to manufacture a heat treated galvannealed steel material, or it may be a hardenable steel which can be hardened at the time of hot bending to increase its strength and obtain a heat treated galvannealed steel material. The heat treated galvannealed steel material can be subjected to chemical conversion treatment and electro-deposition coating to form a chemical conversion coating and electro-deposition coating atop the remaining coating of the heat treated galvannealed steel material. In this manner it is possible to manufacture a 2-dimensionally or 3-dimensionally bent member which has sufficient post-painting corrosion resistance and adhesion of the coating and which is suitable for use as an automotive part.

An example of the chemical composition (mass percent) of a hardenable steel for use as a base metal steel is C: at least 0.1% and at most 0.3%, Si: at least 0.01% and at most 0.5%, Mn: at least 0.5% and at most 3.0%, P: at least 0.003% and at most 0.05%, S: at most 0.05%, Cr: at least 0.1% and at most 0.5%, Ti: at least 0.01% and at most 0.1%, Al: at most 1%, B: at least 0.0002% and at most 0.004%, N: at most 0.01%, optionally at least one element selected from the group consisting of Cu: at most 1%, Ni: at most 2%, Mo: at most 1%, V: at most 1%, Nb: at most 1%, and a remainder of Fe and impurities.

From a galvannealed steel material such as a channel member in which the base metal steel has the above-described chemical composition, it is possible to manufacture a heat treated galvannealed steel material having a tensile strength of at least 1200 MPa by heating to a temperature at which quench hardening is possible followed by rapid cooling.

A galvannealed steel sheet which can be used as a starting material for this heat treated galvannealed steel material can be manufactured in a conventional manner by performing hot dip galvanizing or electrogalvanizing after hot rolling and pickling, or by performing hot dip galvanizing after cold rolling, or by performing electrogalvanizing after cold rolling and annealing, before performing annealing.

In order to manufacture a heat treated galvannealed steel material according to this embodiment, at least a portion of the above-described galvannealed steel material is heated to a temperature range in which quench hardening is possible and then subjected to hot bending and quenching of the heated portion sequentially or simultaneously. At this time, the surface roughness Ra of the coating layer of the galvannealed steel material prior to heating is previously adjusted to at most 0.8 μm. As a result, the loss of the zinc coating layer during heating in a high temperature range is suppressed, and the surface roughness of the remaining coating is regulated by leveling of the η phase in the coating, thereby making it possible to achieve sufficient degreasing ability to guarantee the level of post-painting corrosion resistance demanded of automotive parts.

With a heat treated galvannealed steel material according to the present invention, the coating remaining on the surface of the portion which underwent heat treatment has a coating weight in the range of at least 20 g/m$^2$ and at most 80 g/m$^2$ per side. If the weight of the remaining coating is less than 20 g/m$^2$, the effect of suppressing the corrosion depth of scratched portions of a paint coating is inadequate to provide corrosion resistance needed by an automotive part. On the other hand, if the coating weight exceeds 80 g/m$^2$, as the coating layer becomes a liquid phase during heating, it is easy for dripping of liquid or adhesion of splashed molten Zn to occur, and the external appearance may become defective. When the coating contains Fe and Al, these elements are included in the weight of the coating.

This embodiment of a heat treated galvannealed steel material has a centerline average roughness Ra prescribed by JIS B 0610 of at most 1.5 μm on the surface of the coating. If the centerline average roughness Ra exceeds 1.5 μm, the ability to perform degreasing to remove the rust preventing oil which is applied to the surface for temporary rust prevention becomes inadequate, thereby causing repulsion of water or making the coating weight of a chemical conversion coating formed thereon inadequate. As a result, the post-painting corrosion resistance by electro-deposition coating which is subsequently applied tends to deteriorate.

In this embodiment of a heat treated galvannealed steel material, it is not necessary for the centerline average roughness Ra of the surface of the coating to be at most 1.5 μm over the entirety of the heat treated portion of the coating. It is sufficient for the particularly important surfaces or parts or the like of the portions which underwent heat treatment to have a centerline average roughness Ra of at most 1.5 μm.

In order to ensure that the surface roughness Ra of the coating of a heat treated galvannealed steel material of this embodiment is at most 1.5 μm, the surface roughness of the coating layer of the starting material in the form of a galvannealed steel material is made at most 0.8 μm. If the surface roughness of the coating layer of a galvannealed steel material exceeds 0.8 μm, the surface roughness of the coating of a heat treated galvannealed steel material ends up exceeding 1.5 μm. In order to make the surface roughness of the coating layer of a galvannealed steel material at most 0.8 μm, for example, the surface roughness of a roll for temper rolling which is performed on the coated steel sheet which is a starting material for a galvannealed steel material or the surface roughness or holding pressure of a die used when manufacturing a galvannealed steel material by roll forming can be suitably adjusted.

An η phase (Zn) is present in the coating remaining on the surface of a heat treated galvannealed steel material of this embodiment. As described above, even if the surface roughness of the coating layer of a galvannealed steel material is adjusted to be at most 0.8 μm, due to heating at the time of subsequent heat treatment, the surface roughness Ra again increases. However, due to the presence of an η phase remaining in the coating at this time, the molten η phase solidifies in recesses in the coating during cooling and suppresses an increase in the surface roughness Ra.

The Fe content of the coating remaining on the surface of a heat treated galvannealed steel material according to this embodiment is at least 15% and at most 35%. In order to ensure that the coating containing an η phase has resistance to blistering, the Fe content of the coating is made at least 15%. If the Fe content of the coating exceeds 35%, the coating becomes electrochemically too noble and the ability of sacrificial corrosion resistance of the coating decreases. The Fe content is preferably at most 25% and more preferably at most 20%.

The coating remaining on the surface of a heat treated galvannealed steel material according to this embodiment may contain Al, with a preferred Al content being at most 0.45%. If the Al content of the coating layer of a galvannealed steel material exceeds 0.35%, surface irregularities easily form in the coating layer, and in the subsequent heating step, an Fe—Zn alloy phase is non-uniformly formed. As a result, when cooling is subsequently performed, the Al content tends to be concentrated to a level exceeding 0.45%, and the surface roughness of the coating of the heat treated galvannealed steel material is markedly deteriorated. Therefore, the Al content of the coating layer of a galvannealed steel material is preferably made at most 0.45%. Al has the effect of preventing oxidation of Zn. This effect is obtained when the coating layer of a galvannealed steel material contains at least 0.05% of Al.

In a heat treated galvannealed steel material of this embodiment, at least a portion of a galvannealed steel material is subjected to heat treatment by heating to a temperature range in which quench hardening is possible. For example, with some bent members for an automobile, it is sufficient to increase the strength by bending and quenching a portion thereof, and the end portions in the lengthwise direction, for example, sometimes do not undergo bending or quenching. In this case, quenching is carried out on a portion of the heat treated galvannealed steel material, and it is not necessary to have a coating prescribed by the present invention on the entirety of the member.

Next, a method of manufacturing a heat treated galvannealed steel material according to this embodiment will be explained.

In the manufacturing method according to the present invention, it is valuable from a practical standpoint that an elongated or continuous member such as a steel pipe manufactured from a steel sheet can be used as a galvannealed steel material to manufacture a heat treated galvannealed steel material by performing quenching, or hot bending after heating, or simultaneously quenching and hot bending.

For this purpose, in this embodiment, a heat treated galvannealed steel material is manufactured from a galvannealed steel material having on at least one side thereof a coating layer which has a weight of at least 30 g/m$^2$ and at most 90 g/m$^2$ per side, an Fe content of at most 20%, and a surface roughness Ra of at most 0.8 μm by heating at least a portion of the galvannealed steel material to a temperature range in which quench hardening is possible at a rate of temperature increase of at least 3.0×10$^{2}$° C. per second, keeping it at a temperature of at least $8.0\times10^{2}$° C. for at most 2 seconds, and then cooling at a cooling rate of at least $1.5\times10^{2}$° C. per second.

In this embodiment, the coating weight of the coating layer of the galvannealed steel material which is used is made at least 30 g/m$^2$ and at most 90 g/m$^2$ per side. The coating weight includes the content of Fe and Al when they are contained in the coating layer.

In this embodiment, the temperature range in which quench hardening is possible produces a peak metal temperature of about 800° C. or higher, at which a certain proportion of Zn vaporizes during heating. In order to guarantee sufficient corrosion resistance after heating, the coating remaining on the surface of the heat treated galvannealed steel material should have a coating weight of at least 20 g/m$^2$. Therefore, the coating weight of the coating layer of the galvannealed steel material before heat treatment is made at least 30 g/m$^2$. As stated above, if the weight of the coating after heat treatment exceeds 80 g/m$^2$, when the coating becomes a liquid phase during heating, dripping of liquid and the like develop and the external appearance worsens. In order to prevent this problem, the coating weight of the coating layer of the galvannealed steel material before heating is made at most 90 g/m$^2$. From this standpoint, the coating weight of the coating layer of the galvannealed steel material is preferably at least 40 g/m$^2$ and at most 70 g/m.

In this embodiment, the Fe content of a coating layer of a galvannealed steel material before heat treatment is made at most 20%. If the Fe content of the coating layer before heat treatment exceeds 20%, Zn easily dissolves in the base metal steel during heating and forms a solid solution phase, and it becomes difficult for an η phase to remain in the coating after cooling. From this standpoint, the Fe content of the coating layer is preferably at most 15%. The Fe content of a coating layer of a usual mass produced galvannealed steel sheet is less than 15%.

The coating layer of the galvannealed steel material before heat treatment may contain Al, and a preferred Al content of the coating layer is 0.45% or less. If the coating layer contains Al in excess of 0.45%, an Fe—Zn alloy phase is not uniformly formed during the heating step, and the surface roughness of the coating remaining on the heat treated galvannealed steel material after cooling is markedly increased. As a result, it becomes difficult to keep the centerline average roughness Ra of the surface of the coating of the heat treated galvannealed steel material no higher than 1.5 μm.

In this embodiment, at least a portion of a galvannealed steel material having this coating layer on at least one side thereof is heated at a rate of temperature increase of at least $3.0\times10^{2}$° C. per second to a temperature range of at least $8.0\times10^{2}$° C. and at most $9.5\times10^{2}$° C. and kept in this temperature range for at most 2 seconds, and then it is cooled at a cooling rate of at least $1.5\times10^{2}$° C. per second.

If the rate of temperature increase is less than $3.0\times10^{2}$° C. per second or if the cooling rate is less than $1.5\times10^{2}$° C. per second, the length of the heat cycle for heat treatment becomes long, so vaporization or oxidation of Zn is promoted, alloying of the coating layer becomes excessive, and there may be possibility of embrittlement of molten zinc occurring depending upon the base metal steel.

In this embodiment, the steel material is maintained in a temperature range of at least $8.0\times10^{2}$° C. for at most 2 seconds before it is cooled. If the duration for which the steel material is kept at a temperature of at least $8.0\times10^{2}$° C. is more than 2 seconds, excessive alloying takes place in the coating layer, and the corrosion resistance of the zinc-based coating layer deteriorates. From the same standpoint, the duration is preferably at most 1 second.

The maximum temperature which is reached by the steel material at the time of heating is made at most $9.5\times10^{2}$° C. According to an equilibrium phase diagram for a Zn—Fe alloy, the melting point of a Zn—Fe alloy containing approximately 10% of Fe (at which it is entirely in liquid phase) is in the vicinity of 930° C. Therefore, if the temperature of the steel material at the time of heating is too high, fluidization and vaporization of the surface become marked, leading to loss of the coating.

In a manufacturing method according to this embodiment, by prescribing the Fe content and the surface roughness Ra of the coating of the galvannealed steel material, and the rate of temperature increase, the keeping time, and the cooling rate during heat treatment, the centerline average roughness Ra of the surface of the coating remaining on the heat treated galvannealed steel material which is manufactured can be made a small value of at most 1.5 μm.

FIG. 1 is an explanatory view schematically showing an example of a manufacturing apparatus for a heat treated galvannealed steel material of this embodiment.

In the manufacturing apparatus shown in FIG. 1, a material to be worked 1 is a round pipe having a circular transverse cross-sectional shape. A material to be worked in the form of a galvannealed steel material 1*a* is successively and continuously heated so as to form a locally heated portion, which is plastically deformed using a movable roller die 4 and immediately thereafter cooled to manufacture a heat treated galvannealed steel material 1*b*.

For this purpose, the manufacturing apparatus has two pairs of support means (specifically, support rolls) 2 for holding the galvannealed steel material 1*a* so that it can be rotated, and a feed device 3 for advancing the galvannealed steel material 1*a* bit by bit or continuously from the upstream side thereof. On the downstream side of the two pairs of support means (the support rolls) 2, a movable roller die 4 which clamps the galvannealed steel material 1*a* and controls the clamping position or the clamping position and the speed of movement is provided.

On the entrance side of the movable roller die 4, a high-frequency induction heating coil 5 is disposed on the outer periphery of the galvannealed steel material 1*a* which is being advanced to heat a portion or the entirety of the galvannealed steel material 1*a*, and a cooling device (a water cooling device in this embodiment) 6 is disposed for rapidly cooling the galvannealed steel material 1*a* which was rapidly heated by the high-frequency induction heating coil 5.

The movable roller die 4 has a vertical shifting mechanism for vertically shifting the installation position, a left and right shifting mechanism for shifting the installation position to the left and right, a vertical tilting mechanism for tilting the orientation upwards and downwards, a left and right tilting mechanism for tilting the orientation to the left and right, and a moving mechanism for moving the installation position forwards and backwards. As a result, the movable roller die 4 is installed so as to be able to move 3-dimensionally, and by imparting a bending moment to a desired portion of the galvannealed steel material 1*a* while clamping the galvannealed steel material 1*a* so as to enable it to move 3-dimensionally, a heat treated galvannealed steel material 1*b* which is bent 2-dimensionally or 3-dimensionally can be manufactured.

In this manner, according to this embodiment, when a galvannealed steel material undergoes heat treatment to manufacture a heat treated galvannealed steel material having a coating remaining on its surface, by leaving a coating having a prescribed coating weight and adjusting the Fe content of the coating layer such that the remaining coating contains an η phase, the surface condition of the coating can be improved. As a result, a heat treated galvannealed steel material having adequate post-painting corrosion resistance and adhesion of a paint coating required of an automotive part can be manufactured.

EXAMPLES

Next, the present invention will be described more specifically while referring to examples.

In order to confirm the effects of the present invention, a galvannealed steel sheet having a thickness of 1.6 mm was prepared by subjecting a steel sheet as a base metal having the chemical composition shown in Table 1 (the composition other than that shown in Table 1 was Fe and impurities) to hot dip galvanizing and annealing for alloying.

TABLE 1

| | (wt %) | | | | | | | | |
|---|---|---|---|---|---|---|---|---|---|
| | C | Si | Mn | P | S | sol. Al | N | Ti | Nb |
| Base metal | 0.21 | 0.23 | 1.22 | 0.01 | 0.002 | 0.037 | 0.0028 | 0.028 | — |

The galvannealed steel sheet was subjected to UO forming (forming into the shape of a U with a Uing press and subsequent forming into the shape of an O with an Oing press), and then it was laser welded to prepare a galvannealed steel material for testing in the form of a rectangular pipe having a cross-sectional shape measuring 50 mm×35 mm, a corner radius R of approximately 5 mm, and a pipe length of 2000 mm.

Table 2 shows the coating weight of the coating layer (the coating weight before heating), the Fe content (the Fe concentration in the coating), the Al content (the Al concentration in the coating), and the surface roughness Ra of the coating layers of Samples 1-23 of rectangular pipes which were prepared in this manner.

TABLE 2

| Sample No. | Coating weight before heating ($g/m^2$) | % Fe of coating | % Al of coating | Surface roughness Ra (μm) | Rate of temp. increase (° C./s) | Max temp. readhed (° C.) | Keeping time (sec) | Cooling rate (° C./s) | Coating weight after heating ($g/m^2$) | Surface roughness Ra (μm) |
|---|---|---|---|---|---|---|---|---|---|---|
| 1 | 45 | 10 | 0.25 | 1.3 | 400 | 900 | 1.5 | 200 | 32 | 3.7 |
| 2 | 45 | 10 | 0.25 | 0.9 | 400 | 900 | 1.5 | 200 | 32 | 2.4 |
| 3 | 45 | 10 | 0.25 | 0.6 | 400 | 900 | 1.5 | 200 | 32 | 1.5 |
| 4 | 45 | 10 | 0.25 | 0.4 | 400 | 900 | 1.5 | 200 | 32 | 0.9 |
| 5 | 45 | 13 | 0.25 | 0.6 | 400 | 900 | 1.5 | 200 | 31 | 1.4 |
| 6 | 45 | 16 | 0.25 | 0.6 | 400 | 900 | 1.5 | 200 | 29 | 1.4 |
| 7 | 45 | 19 | 0.25 | 0.6 | 400 | 850 | 1.5 | 200 | 28 | 1.3 |
| 8 | 45 | 22 | 0.25 | 0.6 | 400 | 850 | 1.5 | 200 | 23 | 1.1 |
| 9 | 25 | 10 | 0.45 | 0.6 | 400 | 900 | 1.5 | 200 | 19 | 1.2 |
| 10 | 35 | 10 | 0.32 | 0.6 | 400 | 900 | 1.5 | 200 | 25 | 1.3 |
| 11 | 70 | 10 | 0.16 | 0.4 | 400 | 900 | 1.5 | 200 | 48 | 1.2 |
| 12 | 80 | 9 | 0.14 | 0.4 | 400 | 900 | 1.5 | 200 | 54 | 1.3 |
| 13 | 95 | 9 | 0.10 | 0.4 | 400 | 900 | 1.5 | 200 | 62 | dripping |
| 14 | 45 | 10 | 0.00 | 0.6 | 400 | 900 | 1.5 | 200 | 25 | 0.9 |
| 15 | 45 | 10 | 0.20 | 0.6 | 400 | 900 | 1.5 | 200 | 31 | 1.4 |
| 16 | 45 | 10 | 0.38 | 0.6 | 400 | 900 | 1.5 | 200 | 33 | 1.7 |
| 17 | 45 | 10 | 0.25 | 0.6 | 200 | 900 | 1.5 | 200 | 32 | 2.9 |
| 18 | 45 | 10 | 0.25 | 0.4 | 300 | 900 | 1.5 | 200 | 32 | 1.2 |
| 19 | 45 | 10 | 0.25 | 0.6 | 600 | 900 | 1.5 | 200 | 32 | 1.0 |
| 20 | 45 | 10 | 0.25 | 0.6 | 400 | 900 | 1.5 | 100 | 32 | 2.9 |
| 21 | 45 | 10 | 0.25 | 0.6 | 400 | 900 | 1.5 | 300 | 32 | 1.0 |
| 22 | 45 | 10 | 0.25 | 0.6 | 400 | 900 | 3 | 200 | 31 | 1.8 |
| 23 | 45 | 10 | 0.25 | 0.6 | 400 | 900 | 5 | 200 | 29 | 2.1 |

| Sample No. | % Fe of coating | % Al of coating | Presence of η phase | Wettability by water | Width of blistering in damaged portion (mm) | Max. corroded depth in injured portion (mm) | Remarks |
|---|---|---|---|---|---|---|---|
| 1 | 20.5 | 0.35 | ○ | x | 6.9 | 0.35 | |
| 2 | 20.5 | 0.35 | ○ | Δ | 4.8 | 0.35 | |
| 3 | 20.5 | 0.35 | ○ | ○ | 3.4 | 0.35 | Inventive |
| 4 | 20.5 | 0.35 | ○ | ○ | 2.5 | 0.35 | Inventive |
| 5 | 25.2 | 0.36 | ○ | ○ | 3.3 | 0.36 | Inventive |
| 6 | 31.1 | 0.39 | ○ | ○ | 3.2 | 0.38 | Inventive |
| 7 | 33.3 | 0.41 | ○ | ○ | 3.1 | 0.39 | Inventive |
| 8 | 45.3 | 0.49 | x | ○ | 2.9 | 0.44 | |

TABLE 2-continued

| | | | | | | | |
|---|---|---|---|---|---|---|---|
| 9 | 19.8 | 0.61 | ○ | ○ | 2.9 | 0.49 | |
| 10 | 20.2 | 0.45 | ○ | ○ | 3.1 | 0.42 | Inventive |
| 11 | 21.0 | 0.24 | ○ | ○ | 3.0 | 0.23 | Inventive |
| 12 | 19.7 | 0.21 | ○ | ○ | 3.2 | 0.19 | Inventive |
| 13 | 20.1 | 0.15 | ○ | ○ | — | — | |
| 14 | 24.3 | 0.00 | ○ | ○ | 2.5 | 0.42 | Inventive |
| 15 | 20.7 | 0.29 | ○ | ○ | 3.3 | 0.36 | Inventive |
| 16 | 20.0 | 0.52 | ○ | ○ | 3.5 | 0.34 | Inventive |
| 17 | 20.5 | 0.35 | ○ | x | 5.7 | 0.35 | |
| 18 | 20.5 | 0.35 | ○ | ○ | 3.0 | 0.35 | Inventive |
| 19 | 20.5 | 0.35 | ○ | ○ | 2.6 | 0.35 | Inventive |
| 20 | 20.5 | 0.35 | ○ | x | 5.7 | 0.35 | |
| 21 | 20.5 | 0.35 | ○ | ○ | 2.6 | 0.35 | Inventive |
| 22 | 21.7 | 0.36 | ○ | Δ | 3.9 | 0.36 | |
| 23 | 23.5 | 0.39 | ○ | Δ | 4.4 | 0.38 | |

Using Samples 1-23 of rectangular pipes as materials to be worked, heating, temperature keeping, and cooling were carried out under the heat treatment conditions (rate of temperature increase, maximum temperature, keeping time, and cooling rate) shown in Table 2 to manufacture heat treated galvannealed steel materials 1-23 from the rectangular pipes.

Heating of rectangular pipes 1-23 was carried out using a high-frequency induction heating device, and cooling was carried out using a water cooling device or an air cooling device located immediately downstream of the high-frequency induction heating apparatus. In this example, hot bending was not carried out in order to simplify the test conditions.

Each of the resulting heat treated galvannealed steel materials 1-23 in the form of rectangular pipes was immersed in an aqueous 10% hydrochloric acid solution to which an inhibitor (1 g/L of 700 BK manufactured by Asahi Chemical Industry) was added until the coating of the steel material dissolved in the solution. The resulting solution was used to determine the coating weight, the Fe content, and the Al content by ICP spectroscopy and atomic absorption spectrometry. Table 2 shows the results of measurement of the coating weight (the coating weight after heating), the Fe content (% Fe of the coating), and the Al content (% Al of coating). These measured values include Zn oxides present atop the coating and scale interspersed in the coating layer.

The surface roughness Ra of the coating layers of the heat treated galvannealed steel materials 1-23 was measured using an instrument SURFCOM manufactured by Tokyo Seimitsu Co., Ltd. In accordance with JIS B 0610 with setting a cutoff value at 0.8 mm. The results of this measurement are shown in Table 2. The presence of an η phase in the coating layer was ascertained by cutting out a test piece and determining by x-ray diffractometry whether there was a peak of the η-Zn (002) plane. The case in which a peak could not be ascertained is shown by an "X" mark in Table 2.

In order to evaluate wettability by water, a test piece with a length of 150 mm was cut from the heat treated galvannealed steel materials 1-23, and a rust-preventing oil, SKW92 manufactured by Idemitsu Kosan Co., Ltd. was applied to the test pieces in an amount of 2 g/m$^2$ for temporary rust prevention. After the test pieces were allowed to stand upright for 1 day, they were degreased using a degreasing solution L4380 manufactured by Nihon Parkerizing Co., Ltd., and the % of area wetted by water after washing with water was evaluated. The results of evaluation are shown in Table 2. The evaluation standard was CIRCLE when the percent of wetted area was at least 80%, it was TRIANGLE when the percent of wetted area was less than 80% and at least 50%, and it was "X" when the percent of wetted area was less than 50%.

A test piece of each sample was treated after usual degreasing treatment by zinc phosphating using a solution PBL-3080 manufactured by Nihon Parkerizing Co., Ltd. under conventional chemical conversion treatment conditions and then paint-coated by electro-deposition using New Paint Black E FU-NPB which is an electro-deposition paint manufactured by C. Uyemura & Co., Ltd. with a sloping current at a voltage of 200 V followed by baking at a baking temperature of 170° C. for 20 minutes. The resulting electro-deposited coating was damaged by a scratch down to the base metal using a cutting knife and then exposed to repeated 90 cycles each consisting of salt spraying prescribed by JASO M609-91 (2 hours at 35° C. using 5% NaCl), drying (4 hours at 60° C. with a relative humidity of 30%), and moistening (2 hours at 50° C. with a relative humidity of 95%). The width of swelling of the coating or the rust width (the width of blistering in damaged portion) and the maximum corroded depth of the damaged portion were measured to evaluate post-painting corrosion resistance.

Corrosion resistance after paint coating is regarded as good when the width of swelling of the damaged portion (width of blistering in damaged portion) is at most 3.5 mm and poor when it is greater than 3.5 mm, or good when a maximum corroded depth of the damaged portion is at most 0.43 mm and poor when it is greater than 0.43 mm. The results are shown in Table 2.

Samples 3-7, 10-12, 14-16, 18, 19, and 21 in Table 2 are all examples of the present invention which satisfied all of the conditions prescribed by the present invention. Samples 1, 2, 8, 9, 13, 17, 20, 22, and 23 are comparative examples which did not satisfy one or more of the conditions prescribed by the present invention.

Samples 3-7, 10-12, 14-16, 18, 19, and 21 which are examples of the present invention all satisfy the properties of the coating layer before heat treatment, the heat treatment conditions, and the resulting coating properties after heat treatment prescribed by the present invention, so the width of blistering of the damaged portion was at most 3.5 mm and the maximum corroded depth of the damaged portion was at most 0.43 mm. Therefore, the post-painting corrosion resistance and the evaluation of external appearance were both good.

In contrast, Samples 1 and 2 had a surface roughness of the coating before heating which exceeded the upper limit of the range prescribed by the present invention. As a result, the surface roughness of the coating remaining after heating exceeded the upper limit of the range prescribed by the present invention, and the width of blistering of the damaged portions had poor values of 6.9 mm and 4.8 mm, respectively.

In Sample 8, the Fe content of the coating layer before heating exceeded the upper limit of the range prescribed by the present invention, so the Fe content of the coating remaining after heating exceeded the upper limit of the range prescribed by the present invention, and an η phase was not present in the remaining coating. As a result, the maximum corroded depth of the damaged portion had a poor value of 0.44 mm.

In Sample 9, the weight of the coating before heating was below the lower limit of the range prescribed by the present invention. Therefore, the weight of the coating remaining after heating was below the lower limit of the range prescribed by the present invention, and the maximum corroded depth of the damaged portion had a poor value of 0.49 mm.

In Sample 13, the weight of the coating before heating exceeded the upper limit of the range of the prescribed by the present invention, so dripping of liquid took place and the external appearance was poor. Therefore, the post-painting corrosion resistance was not evaluated.

In Sample 17, the rate of temperature increase during heating was below the lower limit of the range prescribed by the present invention, so the surface roughness of the coating remaining after heating exceeded the upper limit of the range prescribed by the present invention, and the width of blistering of the damaged portion had a poor value of 5.7 mm.

In Sample 20, the cooling rate after heating was below the lower limit of the range prescribed by the present invention, so the surface roughness of the coating remaining after heating exceeded the upper limit of the range prescribed by the present invention, and the width of blistering of the damaged portion had a poor value of 5.7 mm.

In Samples 22 and 23, the length of time (the keeping time) in the temperature range of at least 800° C. during heating exceeded the upper limit of the range prescribed by the present invention. Therefore, the surface roughness of the coating remaining after heating was greater than the upper limit of the range prescribed by the present invention, and the width of blistering of the damaged portion had a poor value of 3.9 mm and 4.4 mm, respectively.

The invention claimed is:

1. A heat treated galvannealed steel material formed from a galvannealed steel material, characterized in that the steel material has a rapidly cooled structure, a coating remaining on the surface of at least a part of the portion of the steel material has a coating weight of at least 20 g/m$^2$ and at most 80 g/m$^2$ per side and an Fe content of at least 15% and at most 35% in mass percent, an η phase is present in the coating, and the centerline average roughness Ra prescribed by JIS B 0610 of the surface of the coating is at most 1.5 μm.

2. A heat treated galvannealed steel material as set forth in claim 1 characterized in that the remaining coating contains at most 0.45 mass percent of Al.

3. The heat treated galvannealed material as set forth in claim 1, characterized in that the heat treated galvannealed steel material is an automobile part.

4. The heat treated galvannealed material as set forth in claim 1, characterized in that the heat treated galvannealed steel material is a hot-bent pipe.

5. The heat treated galvannealed material as set forth in claim 4, characterized in that the hot-bent pipe is an automobile part.

6. The heat treated galvannealed material as set forth in claim 1, characterized in that the heat treated galvannealed steel material is a hot-bent tapered steel member.

7. The heat treated galvannealed material as set forth in claim 6, characterized in that the hot-bent tapered steel member is an automobile part.

8. The heat treated galvannealed steel material as set forth in claim 1, wherein the coating-containing steel material has a paint layer on a surface thereof.

9. A hot-formed and heat treated galvannealed steel member having a rapidly-cooled structure, characterized in that a coating remaining on the surface of at least a part of the portion of the steel member has a coating weight of at least 20 g/m$^2$ and at most 80 g/m$^2$ per side and an Fe content of at least 15% and at most 35% in mass percent, and eta-phase is present in the coating, and the centerline average roughness Ra prescribed by JIS B 0610 of the surface of the coating is at most 1.5 micrometers.

10. The hot-formed member as set forth in claim 9 characterized in that the remaining coating contains at most 0.45 mass percent of Al.

11. The hot-formed member as set forth in claim 9, characterized in that the member is an automobile part.

12. The hot-formed member as set forth in claim 9 characterized in that the member is a hot-bent pipe.

13. The hot-formed member as set forth in claim 12, characterized in that the hot-bent pipe is an automobile part.

14. The hot-formed member as set forth in claim 9, characterized in that the member is a hot-bent tapered steel member.

15. The hot-formed member as set forth in claim 14, characterized in that the hot-bent tapered steel member is an automobile part.

16. The hot formed member as set forth in claim 9, wherein the coating-containing steel member has a paint layer on a surface thereof.

* * * * *